United States Patent [19]

Rosen

[11] 4,386,616

[45] Jun. 7, 1983

[54] CIGARETTE TUBE

[76] Inventor: Louis M. Rosen, 7 E. 14th St., Apt. 305, New York, N.Y. 10003

[21] Appl. No.: 244,683

[22] Filed: Mar. 17, 1981

[51] Int. Cl.[3] ..... A24F 13/16

[52] U.S. Cl. ..... 131/174; 131/175

[58] Field of Search ..... 131/175, 174

[56] References Cited

U.S. PATENT DOCUMENTS

| | | | |
|---|---|---|---|
| 35,926 | 7/1862 | Ernst . | |
| 447,653 | 3/1891 | Arbtin . | |
| 502,992 | 8/1893 | Phillips et al. . | |
| 1,623,635 | 4/1927 | Potts . | |
| 1,850,503 | 3/1932 | Hunter . | |
| 2,302,154 | 11/1942 | Swem | 131/175 X |
| 2,541,837 | 2/1951 | Schroff . | |
| 2,768,630 | 10/1956 | Johnson . | |
| 3,821,958 | 7/1974 | Overleese | 131/174 X |
| 3,827,444 | 8/1974 | Khan | 131/175 X |

*Primary Examiner*—Stephen C. Pellegrino
*Attorney, Agent, or Firm*—Kenyon & Kenyon

[57] ABSTRACT

A tubular safety enclosure, adapted to be fitted about a cigarette while being smoked in order to minimize fire hazards, is disclosed. The safety enclosure is provided with two sections, one suitable for engagement with the filter end of the cigarette and the other providing an enclosure for the tobacco portion of the cigarette. In this manner, the smoker may continue to engage his lips with the filter portion of the cigarette in the conventional manner while being provided with a safety enclosure.

4 Claims, 3 Drawing Figures

CIGARETTE TUBE

BACKGROUND OF THE INVENTION

This invention relates to a cigarette tube and in particular to one for enclosing the tobacco portion of the cigarette in order to minimize fire hazards.

Under certain conditions, it has been found desirable to provide a safety enclosure for use during cigarette smoking so as to prevent the ashes from dropping and otherwise minimize the risk of creating a fire hazard. Also, in certain instances, smoking in and of itself is objectionable. In the past, cigarette holders have been provided, many of which were found objectionable in that the smoker was required to engage the plastic or metal end of the device with the lips rather than the cigarette in a conventional manner. In addition other devices were complex and expensive. By the means disclosed herein, the drawbacks which exist in the prior art are overcome.

SUMMARY OF THE INVENTION

It is an object of the present invention to provide a safety enclosure for cigarettes which is inexpensive to produce and does not interfere with the enjoyment of smoking.

It is another object of this invention to provide a cigarette safety enclosure which will minimize fire hazards and facilitate smoking of the cigarette in a conventional manner.

It is still another object of this invention to provide a cigarette holder which is inexpensive and disposable.

These and other objects of the invention will become more apparent when taken in accordance with the disclosed embodiment in which a two piece tubular safety enclosure is provided. One piece of the assembly is a thin cylindrical sleeve member having an inner diameter slightly larger than the outer diameter of the filter end of the cigarette. The cylindrical sleeve facilitates mounting of the enclosure about the cigarette. A tubular extension member is provided to contain the tobacco portion of the cigarette being of a length slightly less than that of the tobacco portion of the cigarette. In this manner when the two-piece tubular safety enclosure is mounted over the cigarette, the latter may be ignited in the conventional manner with the smoker being enabled to engage the cigarette with his lips. Alternatively, when a longer extension member is provided, the cigarette is ignited by removal of the extension member during the cigarette lighting phase and thereafter mounted onto the cylindrical sleeve member positioned at the filter end of the cigarette. In either embodiment, the tubular extension member is of a diameter larger than that of the tobacco portion of the cigarette and is provided with ventilation apertures in the upper surface thereof. The free end of the tubular extension member is provided with a peripheral lip section adapted to prevent the dropping of ashes. At the other end, the tubular extension member is fitted with a mating cylindrical sleeve connected thereto by an inclined transition section. The mating sleeve has an inner diameter sized to facilitate a tight fit with the outer diameter of the cylindrical sleeve mounted to the filter end of the cigarette. The cigarette tube may also be provided mounted on the cigarette by the manufacturer. In this embodiment, the tubular safety enclosure may be of a one piece construction again with the thin cylindrical sleeve member mounted on the filter end of the cigarette and with the tubular extension portion of a length shorter than that of the tobacco portion of the cigarette to allow conventional lighting of the cigarette.

By the means disclosed herein, a smoking appliance provided for use in conjunction with conventional filter type cigarettes. The apparatus of this invention is intended to minimize safety hazards and may be provided as either a reusable appliance or one which is disposable. The two piece assembly may also be provided with threaded portions in lieu of a sliding fit between the cylindrical and mating sleeve members. Preferably the appliance is made of an inexpensive heat resistant and fire proof plastic material.

This and other objects of the invention will be more apparent from the following description of the embodiment thereof when considered along with the accompanying drawings and appended claims.

DESCRIPTION OF THE PREFERRED EMBODIMENT

Figures 1, 2, 3:
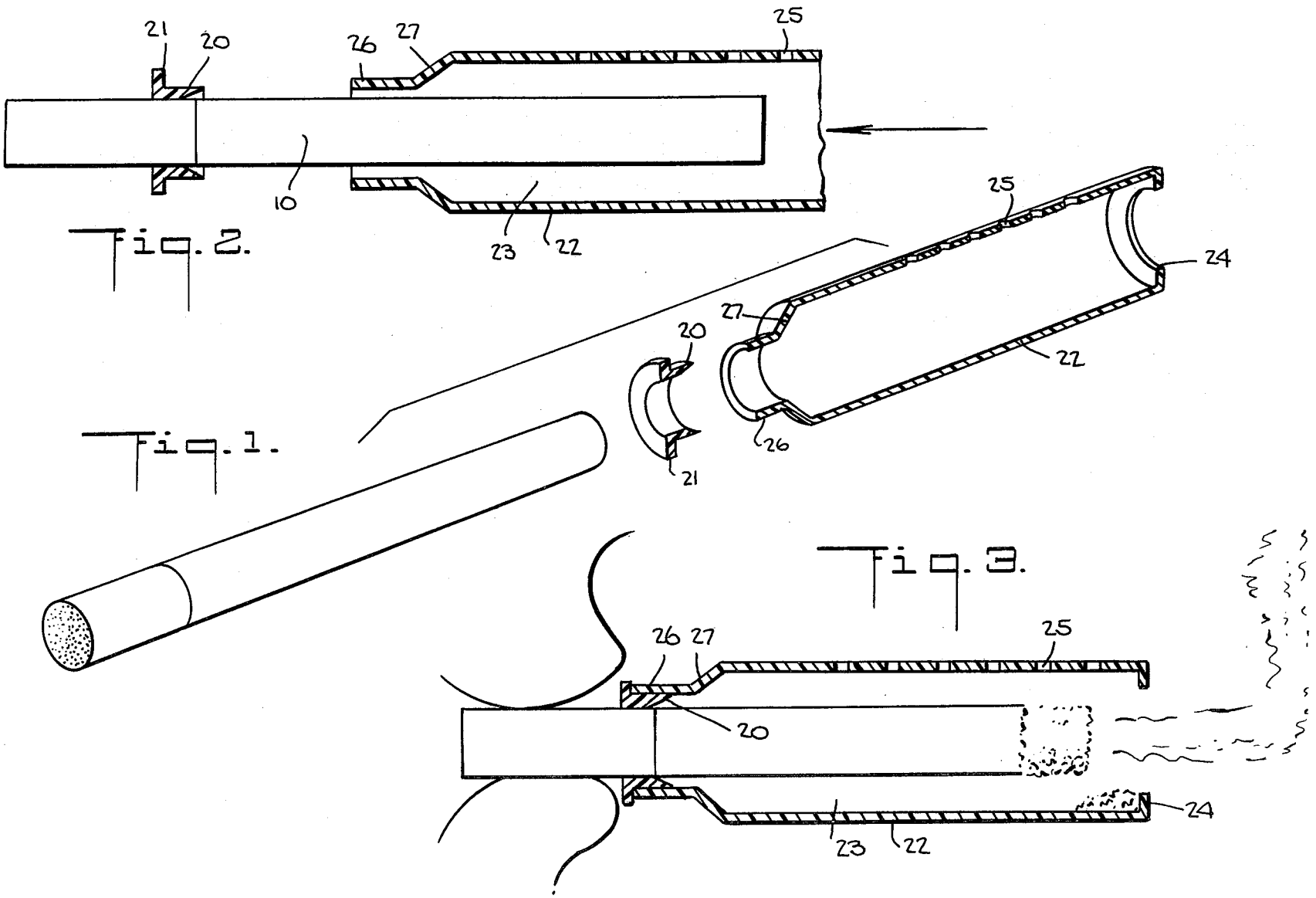
FIG. 1 is an exploded perspective view of the two-piece tubular safety enclosure of this invention and a conventional filter type cigarette.
FIG. 2 is a side elevation view, partially in cross-section, illustrating the manner in which the assembly is mounted on to a cigarette.
FIG. 3 is a side elevation view, partially in cross-section, illustrating the assembly mounted to a cigarette being smoked.

A conventional filter type cigarette 10 is illustrated having a cylindrical sleeve member 20 mounted to the filter end of the cigarette. Sleeve member 20 has an inner diameter adapted to be snugly mounted on the forward end of the filter portion of the cigarette and includes a flange or stop member 21.

Tubular extension 22 is provided with an outer diameter significantly larger than that of the tobacco portion of the cigarette so that when assembled, a sufficient air space 23 is provided to sustain combustion during the smoking of a cigarette. The free end of the tubular member 22 is provided with a peripheral lip 24 which is adapted to restrict or prevent the dropping of ashes when the cigarette is downwardly tilted. A plurality of apertures 25 are provided in the upper portion of the tubular extension 22 in order to provide ventilation during the smoking of the cigarette. In lieu thereof, slots could also be provided. It is, however, noted that the apertures or slots 25 must be mounted such that they are located in the upper portion of tubular extension 22 otherwise ashes will drop from the enclosure during smoking.

At the other end of the tubular extension 22 is a mating sleeve 26 which is connected to the outer diameter by an inclined transition section 27. Mating sleeve 26 is provided with inner diameter adapted to be snugly fit onto the cylindrical sleeve member 20 mounted on the filter portion of the cigarette. FIGS. 2 and 3 indicate how, in the preferred embodiment, the cylindrical sleeve 20 contains a tapered lip to aid in sliding the cylindrical sleeve 20 over the cigarette's end.

Preferably both the cylindrical sleeve 20 and tubular member 22 are fabricated using an inexpensive fire proof and heat resistant plastic material. In this manner the assembly may be either provided with the cigarette and disposed of along with the cigarette, or if desired, could be provided as a separate unit which is reusable. With a reusable unit, the cigarette can be lit before the appliance is mounted, and the tubular extension 22 can be the same length as the tobacco portion of a cigarette or a little longer. When the appliance is provided along with the cigarette by the manufacturer, the appliance may be of a one piece construction which is disposable. In addition, it is noted that the tubular assembly 22 could be threadedly mounted to the sleeve 20 under certain circumstances. Thus, by the means disclosed herein a tubular safety enclosure is provided which can be inexpensively manufactured by conventional molding techniques and provide a degree of safety with respect to fire hazards otherwise associated with smoking. Moreover, utilization of the safety enclosure disclosed herein does not present any drawbacks with respect to the conventional enjoyment of cigarette smoking.

Although the above description is directed to a preferred embodiment of the invention, it is noted that other variations and modifications will be apparent to those skilled in the art, and, therefore, may be made without departing from the spirit and scope of the present invention.

What is claimed is:

1. A two-piece tubular safety enclosure for use in conjunction with the smoking of a cigarette that has a filter at one end and a tobacco portion at the other end that is to be lighted, said safety enclosure comprising: an annular member having an inner diameter large enough along its entire length to fit over the filter, at least a portion of the inner diameter of the annular member being small enough to facilitate a tight slidable fit with the filter, said annular member including a small outwardly extending flange and a thin cylindrical sleeve portion extending from the flange toward the end that is to be lighted; the diameter of the inner surface of the forward end of the thin cylindrical sleeve portion of the annular member decreases with increasing distance from the forwardmost end of the annular member to facilitate sliding the annular member over the rear end of the filter; and a tubular extension member comprising a forward tubular portion and a rear tubular portion, said forward tubular portion being adapted to surround the tobacco portion of the cigarette and having an inner diameter larger than the diameter of the cigarette to provide, between the cigarette and the forward tubular portion, an air space that surrounds the tobacco portion of the cigarette and extends longitudinally along the tobacco portion, the inner diameter of the extension member being larger than that of said flange diameter and sufficiently larger than the outer diameter of the cigarette so that said air space is adequate to promote ignition of the tobacco portion, said forward tubular portion having a first wall portion impervious to cigarette ash and extending along the length of the tubular extension member to prevent ash from the tobacco portion of the cigarette from passing through said first wall portion, and a second wall portion extending longitudinally along the tubular extension member and having air intake aperture means to provide ventilation along the tobacco portion of the cigarette adequate to promote ignition thereof, said forward tubular portion having an inwardly extending lip disposed about the periphery of the forward end thereof to prevent the inadvertent dropping of ashes therefrom, said rear tubular portion having an inner diameter of a size to facilitate engagement with the outer surface of the thin cylindrical sleeve portion of the annular member, whereby the inner surface of the cylindrical sleeve portion of the tubular extension member and the outer surface of the thin cylindrical sleeve portion of the annular member can be securely joined together.

2. The apparatus of claim 1 wherein said annular member has an axial length substantially shorter than the length of the filter of the cigarette and wherein the annular member and the tubular extension member are made of a fire proof and heat resistant plastic material.

3. In combination, a cigarette that has a first end to be lighted and a second end not to be lighted; and a tubular safety enclosure that comprises an annular member having an inner diameter large enough along its entire length to fit over the second end of the cigarette, at least a portion of the inner diameter of the annular member being small enough to facilitate a tight slidable fit with a portion of the cigarette sufficiently forward of the second end thereof to permit the part of the cigarette between the annular member and the second end to extend outside of the safety enclosure to be held between a smoker's lips, said annular member including a small outwardly extending flange and a thin cylindrical sleeve portion extending from the flange toward said first end, the diameter of the inner surface of the forward end of the thin cylindrical sleeve portion of the annular member decreases with increasing distance from the forwardmost end of the annular member to facilitate sliding the annular member over the rear end of the filter, said enclosure further comprising a tubular extension member having a forward tubular portion slightly shorter than that part of the cigarette between the annular member and said first end such that, when the tubular member is assembled to the annular member, a small portion of said first end of the cigarette to be lighted extends outward of one end of the tubular extension member to facilitate lighting of the cigarette, the other end of the tubular extension member comprising a rear portion of smaller diameter than said forward tubular portion and having an inner surface that engages firmly the thin cylindrical sleeve portion of the annular member, the tubular extension member having one wall portion impervious to cigarette ashes from said one end to the other end of the tubular extension member and an inwardly extending lip disposed about the periphery of said one end of the tubular extension member to prevent inadvertent dropping of cigarette ashes from the tubular safety enclosure, and a second wall portion extending longitudinally along the tubular extension member and having a plurality of air intake apertures therethrough to provide ventilation, the inner diameter of the tubular extension member being larger than that of said flange diameter and sufficiently larger than the diameter of the cigarette to provide an air space entirely around the cigarette to allow air to pass through the one end and through the air intake apertures to facilitate combustion along the length of the cigarette from the first end thereof to a region adjacent the annular member, the tubular extension member further comprising an inwardly inclined transition section from the rear end of the forward tubular portion of the forward end of the rear tubular portion.

4. The apparatus of claim 3 wherein said annular member and said tubular extension member are made of a fire proof and heat resistant plastic material.

* * * * *